US006928697B2

(12) United States Patent
Brain et al.

(10) Patent No.: US 6,928,697 B2
(45) Date of Patent: Aug. 16, 2005

(54) HINGE

(75) Inventors: Clive W. M. Brain, Gloucestershire (GB); James M. Browne, Gloucestershire (GB)

(73) Assignee: Securistyle Limited, Gloucestershire (GB)

( * ) Notice: Subject to any disclaimer, the term of this patent is extended or adjusted under 35 U.S.C. 154(b) by 0 days.

(21) Appl. No.: 10/431,593

(22) Filed: May 8, 2003

(65) Prior Publication Data

US 2003/0213100 A1 Nov. 20, 2003

(30) Foreign Application Priority Data

May 10, 2002 (GB) ..... 0210782

(51) Int. Cl.[7] ..... E05D 13/00; E05F 1/00

(52) U.S. Cl. ..... 16/193; 16/366; 16/370; 49/248; 49/181

(58) Field of Search ..... 16/193, 93 R, 16/366, 370, 371, 374, 326, 321; 49/248, 245, 246, 250, 252, 176, 177, 181

(56) References Cited

U.S. PATENT DOCUMENTS

| | | | | | |
|---|---|---|---|---|---|
| 3,797,169 | A | * | 3/1974 | Armstrong | 49/248 |
| 4,226,002 | A | * | 10/1980 | Davis | 16/273 |
| 4,622,715 | A | * | 11/1986 | Buckley | 16/370 |
| 4,674,149 | A | * | 6/1987 | Vetter | 16/341 |
| 4,726,092 | A | * | 2/1988 | Tacheny et al. | 16/364 |
| 4,980,947 | A | * | 1/1991 | McQuigge | 16/235 |
| 5,040,267 | A | * | 8/1991 | Dallmann | 16/239 |
| 5,613,277 | A | * | 3/1997 | Dallmann et al. | 16/368 |
| 5,898,977 | A | * | 5/1999 | Muir | 16/363 |

FOREIGN PATENT DOCUMENTS

| | | | | | |
|---|---|---|---|---|---|
| EP | 294980 | A | * | 12/1988 | E05D/15/30 |
| GB | 2236799 | A | * | 4/1991 | E05C/17/34 |
| GB | 2244513 | A | * | 12/1991 | E05C/17/32 |
| GB | 2 262 308 | A | | 6/1993 | |
| GB | 2262565 | A | * | 6/1993 | E05D/15/30 |
| GB | 2279993 | A | * | 1/1995 | E05D/15/30 |
| GB | 2 287 283 | A | | 9/1995 | |
| GB | 2 291 678 | B | | 1/1996 | |
| GB | 2333122 | | | 7/1999 | |
| GB | 2 363 160 | A | | 12/2001 | |
| GB | 2366323 | | | 3/2002 | |

* cited by examiner

*Primary Examiner*—Chuck Mah
(74) *Attorney, Agent, or Firm*—Nixon & Vanderhye

(57) ABSTRACT

A hinge for supporting a vent between a closed position in which it lies within a fixed frame and an open position in which it extends substantially perpendicularly to the fixed frame comprises a support track, a slider mounted on the support track and a vent arm attached to the support track via the slider by a plurality of links. The hinge further comprises a restricting member for acting between the support track and the vent arm wherein upon movement of the vent arm, the restricting member acts to further restrict movement of the vent arm. The slider includes a body portion and a restricting device for engaging the track, in use, to limit movement of the slider, wherein a portion of the restricting device extends into the body portion of the slider to provide reinforcement thereto.

38 Claims, 3 Drawing Sheets

HINGE

This invention relates to hinges, and in particular to a slider for an egress hinge for supporting a vent between a closed position in which it lies within a fixed frame and an open position in which it extends substantially perpendicularly to the fixed frame. The slider may, however, also be used in other forms of hinge, where appropriate.

Egress hinges are well known in the art. For example, GB-2262308B discloses an egress hinge comprising a vent arm for supporting a vent. As the hinge is opened, the vent moves from a closed position within a fixed frame to a fully open position in which the vent extends substantially perpendicularly to the fixed frame. The vent, when in its fully open position, is held by the hinge towards one edge of the fixed frame, thereby providing the largest possible unhindered opening for egress (i.e. when rapid exiting from a building or the like is necessary).

The vent arm of GB-2262308B, together with the links and struts of the hinge, can be released to slide along a support track when the hinge is open. By moving the vent arm in this way, a large access gap is provided between the vent and the fixed frame to allow cleaning of the outside of the vent. The egress hinge comprises a first slider and a second slider mounted in a support track. A vent arm is attached to the first slider via a thrust link and to the second slider via a control link. A brace joins the first slider to a midpoint of the control link. Restricting means act between the first slider and the support track to limit motion of the first slider along the support track during opening of the hinge, thereby dictating the position of the vent arm in relation to the support track when the hinge is fully open. The restricting means are releasable and allow the first slider and hence the vent arm to move relative to the support track when the hinge is in an open position.

The restricting means of GB-2262308B is attached to the first slider and moves along the support track therewith. The restricting means may also be formed integrally with the first slider and may include ears which engage the support track to limit the motion of the first slider. If the support track includes a pair of inwardly facing flanges, the ears of the restricting means preferably engage cut-out regions in the inwardly facing flanges to limit the motion of the first slider, whilst the second slider slides along the web of the support track.

Since in use the sliders of the hinge move along the support track, they are manufactured from plastics material to avoid undue wear. However, for a larger or heavier vent, the components of the hinge are subjected to larger forces and it may be that plastics sliders are not strong enough. The known prior art does not address this problem. Hence, although it is important that the sliders are strong enough to cope with a heavier or larger vent, and there is therefore a demand for such sufficiently strong sliders, the prior art does not suggest how this requirement can be met. The slider and hinge of the present invention overcome this problem.

Accordingly the present invention provides a slider for moving along a track of a hinge, the slider including a body portion and a restricting device for engaging the track, in use, to limit movement of the slider, wherein a portion of the restricting device extends into the body portion of the slider to provide reinforcement thereto.

In an embodiment of the present invention, the restricting device includes a sprung neck portion and a pair of ears extending perpendicularly thereto.

In another embodiment of the present invention, the restricting device is metal.

In an alternative embodiment of the present invention, the body portion is formed from a plastics material.

In yet another embodiment of the present invention, the body portion is moulded.

In one embodiment of the present invention the body portion is channel shaped such that the slider includes a web and two flanges.

In a further embodiment of the present invention the portion of the restricting member that extends into the body portion of the slider is channel shaped.

A slider according to an embodiment of the present invention may also include rivet holes which extend through the portion of the restricting member that extends into the body portion of the slider.

The present invention also provides a hinge for supporting a vent between a closed position in which it lies within a fixed frame and an open position in which it extends at an angle to the fixed frame, the hinge comprising: a support track, a slider mounted on the support track, a vent arm attached to the support track via the slider and a plurality of links, and a restricting member for acting between the support track and the vent arm, wherein upon movement of the vent arm, the restricting member acts to restrict further movement of the vent arm.

In an embodiment of the hinge of the present invention, the restricting member includes a hooked end portion.

In another embodiment of the present invention, the support track of the hinge includes apertures for attaching the support track to a fixed frame. Preferably, the support track includes apertures towards either of its ends as well as at least one aperture towards its centre.

A specific embodiment of the present invention is now described, by way of example only, with reference to the accompanying drawings, in which.

Figure 1:
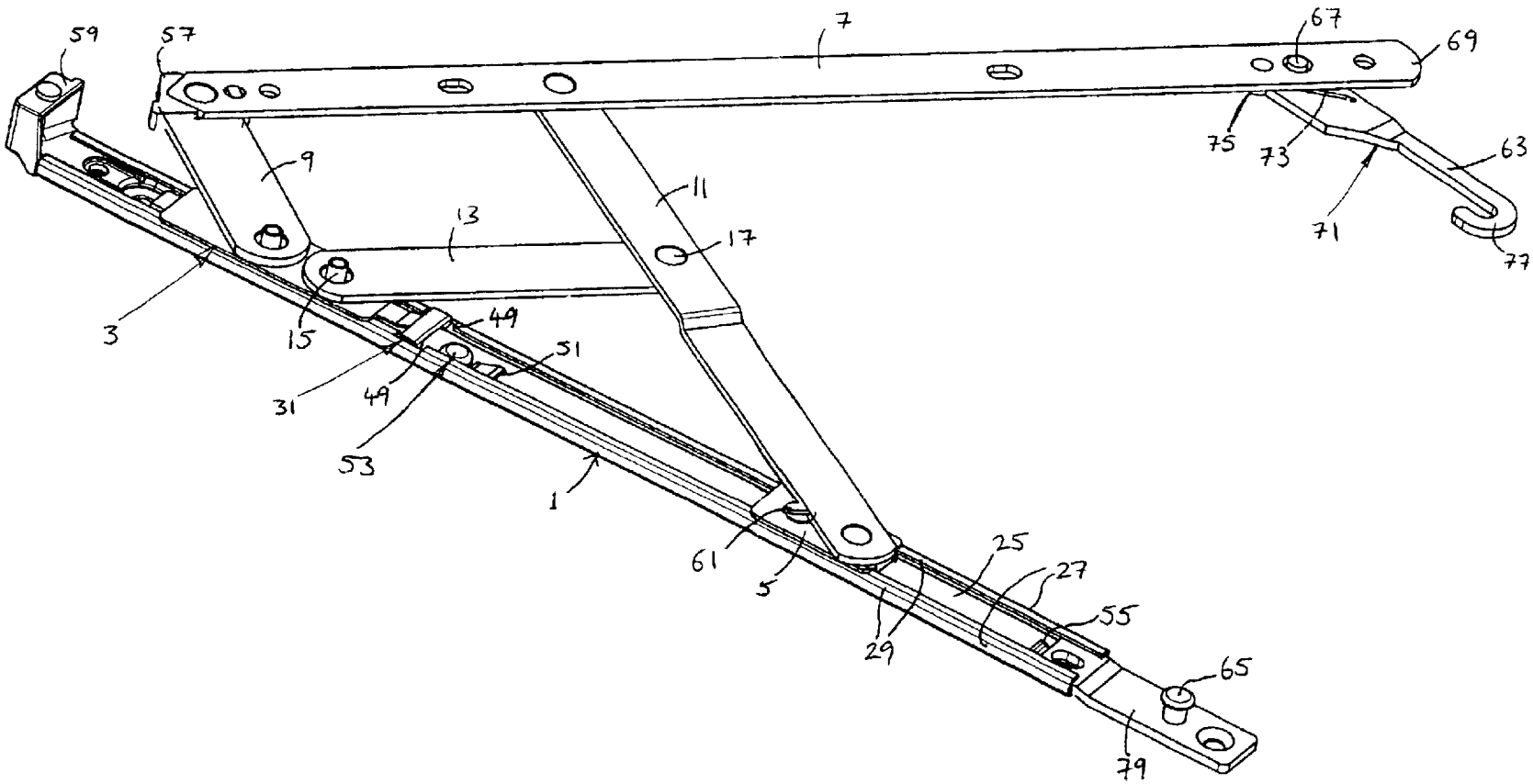
FIG. 1 is an isometric view of an egress hinge according to the present invention in a partly open position.

With reference to the drawings, an egress hinge according to the present invention comprises a support track 1, a first slider 3, a second slider 5 and a vent arm 7.

An end of the vent arm 7 is pivotally attached via a thrust link 9 to the first slider 3. A midpoint of the vent arm 7 is pivotally attached via a control link 11 to the second slider 5. A brace 13 joins the first slider 3 to a midpoint of the control link 11 via pivots 15,17.

The support track 1 comprises a web 25, two side walls 27 and two inwardly facing flanges 29 at the tops of the two side walls 27. The first and second sliders 3,5 are shaped to be received in the support track 1 and to be held therein by means of the flanges 29 in known manner.

Figure 2:
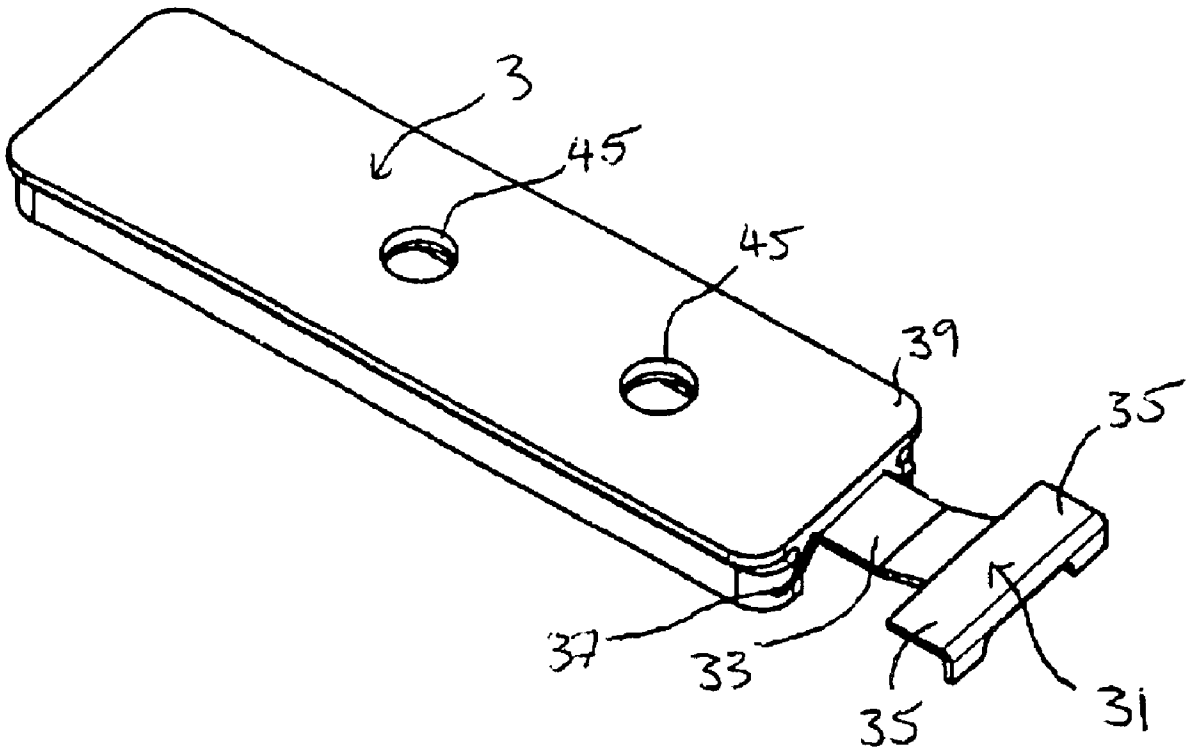
FIG. 2 is an isometric view of a slider according to the present invention.

As can be seen in FIG. 2, restricting device 31 formed integrally with a body portion 39 of the slider 3 comprises a neck region 33 and two ears 35 extending perpendicularly thereto. The neck 33 extends from the body portion 39 of the first slider 3 near to the web 25 of the support track 1 towards the flanges 29. The neck 33 is formed of sprung material and, in this way, the ears 35 of the restricting device 31 are continuously biased against the undersides of the flanges 29.

Figure 3:
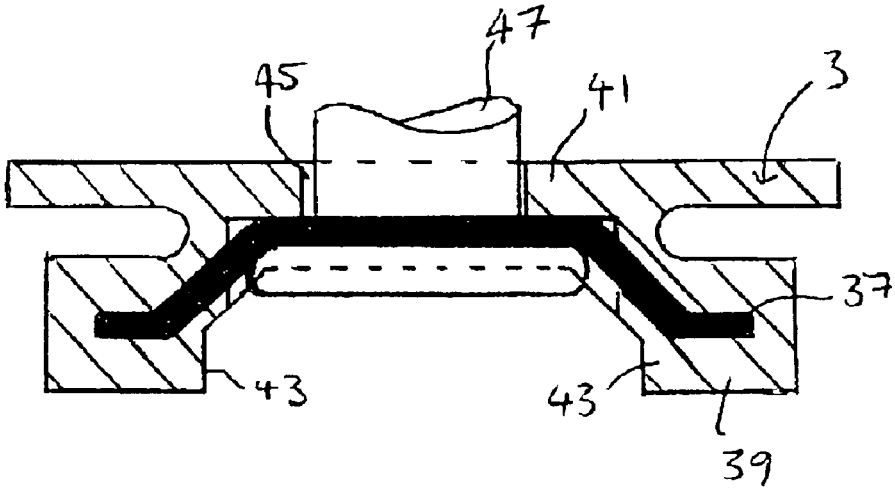
FIG. 3 is a cross sectional end view of the slider of the present invention.

With reference to FIGS. 2 and 3, it can be seen that the first slider 3 is shaped so as to form a channel with a web 41 and flanges 43. However, by cutting out part of the first slider 3 to form such a channel, the strength of the slider 3 is substantially reduced. In order to increase the strength of the slider 3, the restricting device 31 has an extended portion 37 that extends into the body portion 39 of the slider. The restricting device 31 is preferably formed of metal, for example steel. The extended portion 37 forms part of the first slider 3 and is surrounded by body portion 39. Both the extended portion 37 and the body portion 39 are shaped to allow the first slider to slide along the support track 1. Body portion 39 is preferably formed from a plastics material. Furthermore, first slider 3 is provided with apertures 45 through both the body portion 39 and the extended metal portion 37 to accept rivets 47 which connect thrust link 9 and brace 13 to first slider 3, thereby providing additional strength. The rivets are preferably flat headed rivets.

Two cut-out regions 49 in the flanges 29 of the support track 1 are shaped to receive the ears 35 of the restricting device 31. When the ears 35 are received in the cut-out regions 49, the first slider 3 is held in position in the support track 1. The second slider 5 is, however, still free to move along the support track 1, thereby moving the vent arm 7 between its open and closed positions. In this regard, when the second slider 5 is moved to a position adjacent the restricting device 31, the vent arm 7 is substantially perpendicular to the support track 1 and a vent (not shown) mounted thereon is in its fully open position.

On opening the egress hinge from its closed position, the second slider 5 moves along the support track 1 towards the restricting device 31 whilst the first slider 3 is held in a fixed position by means of the ears 35 of the restricting device 31 engaging the cut-out regions 49 of the support track 1. In a preferred embodiment of the present invention there is provided a first stop means 51. The second slider 5 engages the stop means 51 in the support track 1 and therefore its motion is halted. Thus the motion of the vent arm 7 is stopped when it is in its fully open position. In the embodiment shown, the stop means 51 is a crack-stop formed by punching a crack in the web 25 of the support track 1 from below, thereby producing a raised portion within the track 1 itself.

Support track 1 is fixed to a fixed frame (not shown) by a number of fixing means, e.g. rivets or screws, and particularly by fixing means 53 which extends through the web 25 of support track 1. For a larger or heavier vent, the strength of the fixture is improved if the support track of the hinge is fixed to the vent frame in a plurality of places, and particularly near the centre of the length of the track. However, fixing means generally extend above the inner face of the web of the support track. In this case, the sliders of GB-2262308 would hit the portion of the fixing means which extends into the channel of the support track. Therefore, the sliders would not be able to slide along the channel and past the fixing means. Fixing means 53 is positioned between the first slider 3 and the second slider 5 when restricting device 31 is held in its fixed position by ears 35.

When the egress hinge is fully open, the vent mounted on the vent arm 7 is supported at one side of the fixed frame (to which the support track 1 is attached) and does not hinder entry or exit through the frame. If, however, it is desired to clean the outside surface of the vent, the restricting device 31 needs only to be depressed into the support track 1. The ears 35 then disengage from the cut-out regions 49 and the first slider 3 is free to move along the support track 1. Indeed, the vent arm 7, the first slider 3 and the second slider 5, together with the links 9,11 and the brace 13, can be moved relative to the support track 1. Since the first slider 3 is channel shaped, it can freely slide along the support track, and over fixing means 53 without its progress being affected by the presence of the fixing means 53.

When cleaning of the vent has been achieved, if the hinge is once again closed, the first and second sliders 3, 5 will begin to move in opposite directions along the support track 1. Relatively soon, however, the second slider 5 engages a second stop means 55 in the support track 1. In the embodiment shown, the second stop means 55 is also a crack-stop.

When the second slider 5 strikes the second stop means 55, its motion is halted. The only possible motion then is for the first slider 3 to continue in the opposite direction along the support track 1. Eventually, when the hinge is fully closed, the ears 35 of the restricting device 31 engage the cut-out regions 49 in the support track 1. Due to the biased nature of the restricting device 31, the ears 35 engage automatically with the cut-out regions 49. Thus, when the hinge is once again opened, the first slider 3 is held in it normal position towards one end of the support track 1.

An asymmetric end point 57 is provided on the end of the vent arm 7 for engaging with a corresponding asymmetric end cap 59 on the end of the support track 1. Such end points and caps are well known in the art and help to pull in a vent as it closes.

A grub-screw 61 passes through the second slider 5 to bear against the web 25 of the support track 1. By adjusting the grub screw 61, the friction between the second slider 5 and the support track 1 can be varied, thereby enabling the opening and closing of the hinge to be more easily controlled.

In the embodiment shown in FIG. 1, there is also provided a hooked restricting member 63 and a peg 65. Hooked restricting member 63 is connected to vent arm 7 by pivot 67 whilst peg 65 is connected to the end of support track 1. When the vent is closed the hooked restricting member 63 is substantially parallel to the vent arm 7. In the process of opening the vent, the end 69 of vent arm 7 moves away from the support track 1. Restricting member 63 is biased by spring 73 such that in the process of opening the vent, restricting member 63 rotates about pivot 67 towards support track 1. Peg 65 slides along the inner face 71 of hooked restricting member 63 until peg 65 engages with hook 77, thereby restricting any further movement of vent arm 9. To open the vent further and therefore move vent arm 7 further, the vent is first closed slightly and hook 77 is disengaged from peg 65. The vent is then opened further and restricting member 63 rotates further about pivot 67 until restricting member 63 hits stop 75. The vent can therefore be opened until second slider 5 hits first stop 51.

In the process of closing the vent, restricting member 63 strikes peg 65, the restricting member 63 being held in a suitable position by stop 75. Peg 65 pushes restricting member 63 back and slides along inner face 71 until the restricting member 63 lies substantially parallel to vent arm 7. The peg 65 is thus automatically relocated into its original starting position against restricting member 63.

It is clear that alternatively, restricting member 63 could be connected to support track 1 and peg 65 could be connected to vent arm 7, and the restricting member 63 and peg 65 could function in exactly the same way as described above.

The described arrangement is advantageous because the entire restricting member arrangement including the peg and spring are connected to the hinge. Therefore, the entire hinge arrangement including the restricting member can be installed into the fixed frame as a single unit. Accordingly, the peg and restricting member are pre-aligned which means that the installation of the hinge is a simple and quick process.

In the embodiment shown, peg 65 is formed integrally with a section 79 that is attached to the end of the support track 1. Accordingly, the restricting member arrangement lengthens the support track section of the hinge.

It is clear that the slider of the present invention could be used in connection with other hinges in a number of situations. For example, the second slider could be replaced by the slider of the present invention. In this way, the second slider could be used as a locking device thereby enabling the opening of the hinge to be limited. The support track could therefore be fixed to the fixed frame in a number of places without affecting the motion of either the first or second sliders.

Accordingly, the present invention provides an improved slider and hinge since both the hinge and slider of the present invention are stronger than those of the prior art.

It will of course be understood that the present invention has been described above purely by way of example, and that modifications of detail can be made within the scope of the invention.

What is claimed is:

1. A slider for moving along a track of a hinge, the slider including a body portion and a restricting device for engaging the track, in use, to limit movement of the slider, wherein a portion of the restricting device extends into the body portion of the slider to provide reinforcement thereto, the restricting device being metal.

2. A slider according to claim 1 wherein the restricting device includes a sprung neck portion and a pair of ears extending perpendicularly thereto.

3. A slider according to claim 1 wherein the body portion is formed from a plastics material.

4. A slider according to claim 1 wherein the body portion is molded.

5. A slider according to claim 1 wherein the body portion is channel shaped such that the slider includes a web and two flanges.

6. A slider according to claim 1 wherein the portion of the restricting member that extends into the body portion of the slider is channel shaped.

7. A slider according to claim 1 wherein rivet holes extend through the portion of the restricting member that extends into the body portion of the slider.

8. A hinge for supporting a vent between a closed position in which it lies within a fixed frame and an open position in which it extends at an angle to the fixed frame, the hinge comprising:

a support track, a slider mounted on the support track, a vent arm attached to the support track via the slider and a plurality of links, and a restricting member for acting between the support track and the vent arm, wherein upon movement of the vent arm, the restricting member acts to restrict further movement of the vent arm, the restricting member being biased against a stop by a spring.

9. A hinge according to claim 8 wherein the restricting member includes a hooked end portion.

10. A hinge according to claim 8 wherein the restricting member engages a peg mounted on the support track.

11. A hinge according to claim 8 wherein the restricting member is mounted on the vent arm.

12. A hinge according to claim 8 wherein the restricting member can be released thereby allowing the hinge to open and the angle between the vent arm and the support track to increase.

13. A hinge according to claim 8 wherein the restricting member can be released thereby allowing the hinge to open and the angle between the vent arm and the support track to increase, and wherein upon closing the hinge and reducing the angle between the support track and the vent arm, the restricting member automatically relocates into a position in which it can act to restrict further movement of the vent arm.

14. A hinge according to claim 8 wherein the restricting member is biased against a stop by a spring and wherein the stop and spring are carried by the vent arm to which the restricting member is attached.

15. A hinge according to claim 8 wherein the hinge is an egress hinge.

16. A hinge according to claim 8, wherein the support track includes apertures for attaching the support track to a fixed frame.

17. A hinge as claimed in claim 8 wherein the vent arm includes an asymmetric end point which engages in a corresponding end cap on the support track when the hinge is closed.

18. A hinge for supporting a vent between a closed position in which it lies within a fixed frame and an open position in which it extends at an angle to the fixed frame, the hinge comprising:

a support track, a slider mounted on the support track, the slider including a body portion and a restricting device for engaging the track, in use, to limit movement of the slider, wherein a portion of the restricting device extends into the body portion of the slider to provide reinforcement thereto, said restricting device being metal, a vent arm attached to the support track via the slider and a plurality of links, and a restricting member for acting between the support track and the vent arm, wherein upon movement of the vent arm, the restricting member acts to restrict further movement of the vent arm.

19. A hinge according to claim 18 wherein the support track is channel shaped.

20. A hinge according to claim 18 wherein the hinge is an egress hinge.

21. A hinge according to claim 18 wherein the restricting device acts between the slider and the support track to limit motion of the slider along the support track during opening of the hinge, thereby dictating the position of the vent arm in relation to the support track when the hinge is open, the restricting device being releasable to allow the slider and hence the vent arm to move relative to the support track.

22. A hinge according to claim 18 wherein the support track includes apertures for attaching the support track to a fixed frame.

23. A hinge according to claim 18 wherein the support track is channel shaped and wherein the restricting device includes a sprung neck portion and a pair of ears extending perpendicularly thereto, and wherein the channel shaped support track includes a pair of inwardly facing flanges, and the ears of the restricting device engage cut-out regions in the inwardly facing flanges.

24. A hinge as claimed in claim 18, wherein the slider includes a friction adjusting device to control the movement of the slider along the support track.

25. A hinge as claimed in claim 18, wherein the vent arm includes an asymmetric end point which engages in a corresponding end cap on the support track when the hinge is closed.

26. A hinge for supporting a vent between a closed position in which it lies within a fixed frame and an open position in which it extends substantially perpendicularly to the fixed frame, the hinge comprising:

a support track, a first slider mounted on the support track including a body portion and a restricting device for engaging the track, in use, to limit movement of the first slider, wherein a portion of the restricting device extends into the body portion of the first slider to provide reinforcement thereto, said restricting device being metal, a second slider mounted on the support track, and a vent arm attached to the support frame via the first and second sliders by a plurality of links.

27. A hinge according to claim 26 wherein the support track is channel shaped.

28. A hinge according to claim 26 wherein the hinge is an egress hinge.

29. A hinge according to claim 26 wherein the vent arm is attached to the first slider via a thrust link and to the second slider via a control link, and wherein a brace joins the first slider to the control link.

30. A hinge according to claim 26 wherein the restricting device acts between the first slider and the support track to limit motion of the first slider along the support track during opening of the hinge, thereby dictating the position of the vent arm in relation to the support track when the hinge is open, the restricting device being releasable to allow the first slider and hence the vent arm to move relative to the support track.

31. A hinge according to claim 26 wherein the support track includes apertures for attaching the support track to a fixed frame.

32. A hinge according to claim 26 wherein the support track is channel shaped and wherein the restricting device includes a sprung neck portion and a pair of ears extending perpendicularly thereto, and wherein the channel shaped support track includes a pair of inwardly facing flanges, and the ears of the restricting device engage cut-out regions in the inwardly facing flanges.

33. A hinge according to claim 26 further including a stop means against which the second slider bears as the hinge is opened.

34. A hinge according to claim 26 further including a stop means against which the second slider bears as the hinge is closed.

35. A hinge according to claim 26 including a stop means against which the second slider bears as the hinge is opened wherein the stop means is formed integrally with the support track.

36. A hinge as claimed in claim 26 including a stop means against which the second slider bears as the hinge is opened wherein the stop means is a crack-stop extending into the support track.

37. A hinge as claimed in claim 26, wherein the first slider includes a friction adjusting device to control the movement of the first slider along the support track.

38. A hinge as claimed in claim 26, wherein the vent arm includes an asymmetric end point which engages in a corresponding end cap on the support track when the hinge is closed.

* * * * *